US005283031A

United States Patent [19]

Ogasawara et al.

[11] Patent Number: 5,283,031

[45] Date of Patent: Feb. 1, 1994

[54] PROCESS FOR PORDUCING PRECISION METAL PART BY POWDER MOLDING WHEREIN THE HYDROGEN REDUCTION LOSS IS CONTROLLED

[75] Inventors: Naoto Ogasawara, Saitama; Kenji Kurimura; Ken-ichi Yoshioka, both of Tokyo; Shigeru Saito; Takao Kasai, both of Saitama; Masami Hoshi, Tokyo; Seiichi Nakamura, Yamanashi, all of Japan

[73] Assignee: Citizen Watch Co., Ltd., Tokyo, Japan

[21] Appl. No.: 734,509

[22] Filed: Jul. 23, 1991

[30] Foreign Application Priority Data

Jul. 24, 1990 [JP] Japan ..... 2-193837

[51] Int. Cl.[5] ..... B22F 3/12

[52] U.S. Cl. ..... 419/58; 419/28; 419/29; 419/38; 419/36; 419/37; 419/53; 419/57

[58] Field of Search ..... 419/57, 58, 28, 29, 419/38, 63, 36, 37

[56] References Cited

U.S. PATENT DOCUMENTS

| | | | |
|---|---|---|---|
| 3,821,036 | 6/1974 | Copeland et al. | 148/126 |
| 4,190,490 | 2/1980 | Klein et al. | 75/211 |
| 4,225,344 | 9/1980 | Fujimori et al. | 75/203 |
| 4,314,849 | 2/1982 | Ro et al. | 75/228 |
| 4,415,528 | 11/1983 | Wiech, Jr. | 419/46 |
| 4,713,215 | 12/1987 | Madsas | 419/8 |
| 4,722,826 | 2/1988 | Poole | 419/11 |
| 4,836,980 | 6/1989 | Kashiwadani et al. | 419/36 |
| 4,867,439 | 9/1989 | Kiyota | 419/23 |
| 4,921,665 | 5/1990 | Klar et al. | 419/23 |
| 4,927,461 | 5/1990 | Ciloglu et al. | 75/254 |
| 5,152,847 | 10/1992 | LeBeau et al. | 148/513 |

OTHER PUBLICATIONS

McDermott, John, "Powder Metals Technology", Noyes Data Corp., 1974, pp. 3-7.

Hausner, Henry, "Handbook of Powder Metallurgy", Chemical Publishing Co. Inc., 1973, pp. FIG. 7.31, FIG. 1.21.

World Patent Index, File Supplier, Abstract AN=-83-06010k, Derwent Publications Ltd. London, GB; and JP-A-57 198 201 (Daido Tokushuko K.K.) Apr. 12, 1982—Abstract.

Patent Abstracts of Japan, vol. 14, No. 247 (M-978) [4190], May 25, 1990; and JP-A-270 006 (Seilo Instr. Inc.) Aug. 3, 1990-Abstracts.

*Primary Examiner*—Donald P. Walsh
*Assistant Examiner*—Daniel Jenkins
*Attorney, Agent, or Firm*—Flynn, Thiel, Boutell & Tanis

[57] ABSTRACT

A process for producing a precision metal part of a sintered body by powder molding comprises using a metal powder of which the oxygen content and the hydrogen reduction loss are controlled to 0.5-6 wt. % and 1-7 wt. %, respectively. The sintered body has a high density near the theoretical density and is excellent in dimensional accuracy. The molding is facilitated, and the process is simple.

8 Claims, 5 Drawing Sheets

PROCESS FOR PORDUCING PRECISION METAL PART BY POWDER MOLDING WHEREIN THE HYDROGEN REDUCTION LOSS IS CONTROLLED

BACKGROUND OF THE INVENTION

This invention relates to a process for producing a precision metal part, such as a part of a watch, of a sintered body having a high density near the theoretical density.

Recently, various sintered parts using metal powder or ceramic powder have been developed and widely utilized in the fields of general industrial materials, precision machine parts, electronic parts, electric parts, motor car parts and the like. According to this development, the dimensional accuracy, properties, forms etc. required for the parts are severe. A usual powder for molding is produced by using a spray dryer and molded by rubber pressing to obtain a molded body for sintering. The above processes are very complex and the yield of the molded body is very low. Moreover, molded bodies having a complex form cannot be produced.

In order to meet these requirements and problems, some methods were developed comprising imparting plasticity to metal powder or ceramic powder by adding a suitable resin, molding it by the injection molding process, removing the resin in the molded body through thermal decomposition and then sintering to obtain a desired metal or ceramic powder injection molded part (e.g., Japanese Patent KOKOKU No. 51-29170, Japanese KOKAI Nos. 55-113510, 55-113511, etc.). The above methods are noted as removing the organic binder, a resin from the molded body in a short period without inducing cracks, blisters and deformations, as well as not generating cracks in the molded body during the injection molding. However, even though the above problems are resolved, it is difficult to produce precision metal parts having a density near the theoretical density by powder molding, which is an object of the invention. Besides, in general, the oxygen content of metal powder increases by rendering the mean particle size smaller. When the metal powder is reduced in order to decrease the oxygen content, the mean particle size tends to increase due to the condensation or the agglomeration of particles. In the conventional methods, the purity of metal powder is regarded as important and low oxygen content metal powder is used, which is not spherical but irregular shape.

Incidentally, most parts of conventional watches were made of metal and produced by hammering, such as pressing, or cutting, such as lathe processing. However, these processes require a processing time and after steps such as deburring, which increase the labor time. Recently, engineering plastic materials have been developed and many parts of watches are now produced by injection molding.

The conventional gear illustrated in FIG. 6 is a minute wheel 21 which transmits the rotation of the center wheel, as well as moving the minute hand, to the hour wheel moving the watch with deceleration, and consists of two parts, i.e. a minute gear 22 and a minute pinion 23. The minute gear 22 has a hollow disc shape with teeth for engaging the pinion of the central wheel on its circumference, and the minute pinion 23 has teeth on its circumference for engaging the teeth of the hour wheel on the reverse side to the above portion engaging the minute gear 22. The conventional minute gear is produced according to the flow diagram shown in FIG. 7. In the figure, the left side flow scheme indicates the process of producing the minute gear and the right side flow scheme indicates the process of producing the minute pinion. In the process of producing the minute gear, a strip material made of brass (hereinafter referred to as BS) (step A) is punched into a disc (step B). Several pieces of the disc are superposed and milled to form a gear (C). On the other hand, in the process of producing the minute pinion, an iron bar material (step D) is pressed (step E), carburized (step F), hardened (step G) and then tempered (step H). The bar material is cut into a desired form (step I). Subsequently, barrel glazing (step J) and plating (step K) are conducted to complete the minute pinion 23. The minute pinion 23 is incorporated into the minute gear (step L) to complete the minute wheel 21. As mentioned previously, the above conventional process has various problems, such as many processing steps requiring a long time and many processing machines. Moreover, the assembling of plural parts is also necessary which causes assembly troubles. Accordingly, producing more complex part or a smaller part of a watch is difficult by the above manufacturing process.

SUMMARY OF THE INVENTION

An object of the invention is to provide a process capable of producing a precision metal part of a sintered body by powder molding having a density near the true density with a high dimensional accuracy.

Another object of the invention is to provide a process capable of producing a precision metal part of a sintered body by powder molding at a low sintering temperature.

Another object of the invention is to provide a process capable of producing a part of a watch in a simple process with a high reliability.

Still another object of the invention is to provide a process capable of producing a part of a watch having a complex form or a small size with a high dimensional accuracy in a simple process.

The present invention provides a process for producing a precision metal part of a sintered body by powder molding which has achieved the above objects, comprising using a metal powder of which the oxygen content is controlled. Another process for producing a precision metal part of a sintered body by the powder molding which also has achieved the above objects, comprises a step of producing a homogeneous mixture consisting essentially of one or more kinds of metal powders of which the oxygen content is controlled and an organic binder, a step of forming the mixture into a molded body having a prescribed form, a step of removing the organic binder from the molded body, a step of reducing said one or more kinds of metal powders contained in the molded body and a step of sintering the reduced molded body.

The present invention provides a process for producing a part of a watch which has achieved the above objects, comprising a step of producing a homogeneous mixture of a fine uniform iron powder and a plastic binder, a step of forming the mixture into a molded body by injection molding, a step of removing the plastic binder and sintering to produce a semi-fabricated product having a completed form, a step of hardening at least the surface of the semi-fabricated product and a step of plating the surface of the semi-fabricated product.

DETAILED DESCRIPTION OF THE INVENTION

Figure 1:
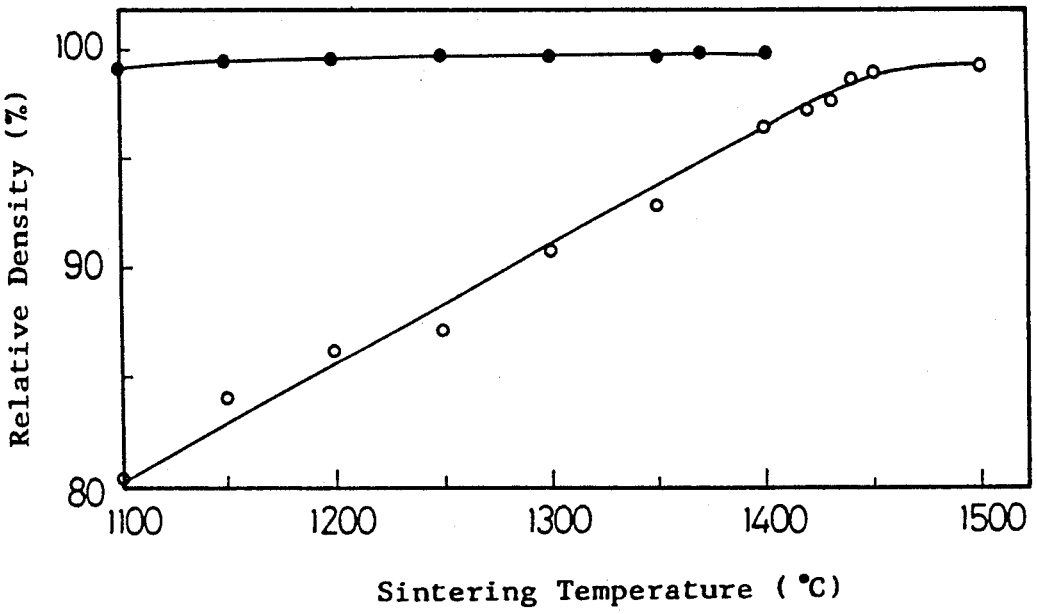
FIG. 1 is a graph indicating the correlation between the relative density of sintered body and the sintering temperature obtained in an example of the invention in comparison with a comparative example.

Metal powders used for powder molding are produced by the mechanical grinding method, the reduction method, the electrolysis method, the carbonyl method, the gas atomizing method, the water atomizing method or the like. The metal powders produced by the gas atomizing method and the water atomizing method are spherical. However, actual metal particles used in the powder molding are condensed or agglomerated and are not spherical in appearance. For example, Inco type 123 nickel powder particles shown in Example 1 of Japanese Patent KOKAI No. 57-16103 are substantially not spheres but spike-like agglomerates. That is, since the oxygen content is less than 0.15 wt. %, the particle surface of the metal powder is active and respective unit particles condense or agglomerate. It is difficult to stabilize the flowability and the dimentional accuracy of the sintered body by using the above powder and to obtain a sintered body having a density near the theoretical density by powder molding. On the other hand, when the metal compound is composed of metal and oxygen, as shown in Japanese Patent KOKAI No. 58-153702, since the oxygen content is great and oxygen also exists on the inside of the metal compound powder, the reduction prior to sintering takes a lot of time. Moreover, it is difficult to obtain a sintered body having a density near the theoretical density by powder molding. In the present invention, metal powder composed of spherical particles without condensation and agglomeration is obtained by using a metal powder composed of spherical particles as the unit particles by using the metal powder of which the oxygen content and the hydrogen reduction loss are controlled.

Thus, the metal powder used as a raw material of the invention has an oxygen content of 0.5 wt. %-6 wt. %, preferably 1 wt. %-3 wt. %, and a hydrogen reduction loss of 1 wt. %-7 wt. %, preferably 2 wt. %-3 wt. %. The oxygen content is a value of elemental analysis and indicates the total oxygen content of the metal powder. The hydrogen reduction loss is the loss in weight from heating the metal powder in a hydrogen reducing atmosphere and includes nitrogen adsorbed water and the like, as well as oxygen. The metal powder is a simplex composed of uniform spheres having a uniform particle distribution. The metal may be alloy and the metal powder may be a plurality of different kinds of metals. The mean particle size of the metal powder is not more than 10 μm, usually 10 μm–0.1 μm, preferably not more than 3 μm. The metal powder can be produced through a method of producing spherical metal powder wherein the reduction amount is controlled.

The organic binder may be a known one and more than 90 wt. % of the organic binder is removed under the sintering temperature, preferably calcining temperature. The organic binder can be selected from ethylene-vinyl acetate copolymer, polyethylene, atactic polypropylene, polystyrene, polybutyl methacrylate, paraffin wax, carnauba wax, etc.

The mixing of the metal powder and the organic binder may be conducted according to a known method. For example, the metal powder and the organic binder are mixed and kneaded by a pressure type kneader in a melted state to obtain a homogeneous mixture efficiently and the mixture has a constant flowability, weight and density.

The mixture is molded into a prescribed form by a known method such as using an injection molding machine. It is possible to conduct a stable molding by using a homogeneous mixture of the metal powder which is a simplex composed of an uniform particle distribution and the organic binder.

The organic binder is removed from the molded body by a known method. The removal of the organic binder is preferably more than 90 wt. %, and more than 95 wt. % is particularly preferred. The atmosphere for the removal of the organic binder is preferably an inert atmosphere. However, it also may be a hydrogen atmosphere or a combination of an inert atmosphere with a hydrogen atmosphere.

The metal powder contained in the molded body is reduced under the sintering temperature, preferably under the calcining temperature, in a reducing atmosphere oven. In this process, more than 90 wt. % of the organic binder covering the surface of the metal powder is removed to increase the void content of the molded body. As a result, the free surfaces of the metal powder, irrespective of being located on the surface or on the inside, are exposed substantially to the reducing atmosphere, and makes it possible to conduct positive reduction. From this viewpoint, it is preferred to remove 100% of the organic binder prior to the reduction of the metal powder. In the reduction step, the metal powder becomes substantially pure metal powder. The reduction step may be combined with the removal step of the organic binder.

The sintering is conducted at a prescribed temperature under a prescribed atmosphere according to the metal powder. The sintering temperature can be lower than that in the conventional process of 1300° C. or more.

The sintered body thus produced is excellent in dimensional accuracy and has a density near the theoretical density, in the range of 99.0%–99.9%, particularly 99.5%–99.9% of the theoretical density.

When the sintered body is used as a module part of a compact watch, at least, the surface may be hardened for improving, the surface hardness and plated for improving the corrosion resistance.

According to the process of the invention, the flowability in the molding process is stable and a sintered body near the theoretical density is easily obtained. The dimensional accuracy of the sintered body is high. The sintering temperature can be lowered resulting in a reduction of manufacturing cost. Since the mixture of the metal powder and the organic binder is excellent in injection moldability, two or three parts can be integrated, and a part having a complex form can easily be produced. Utilizing the great contraction rate, i.e. 15-20%, of the powder injection molding, small parts which are difficult to process by conventional processes can be produced accurately, easily and inexpensively. The weakening of strength due to miniaturization may be compensated for by changing the raw material. In brief, a precision metal part can be produced stably with a high density and a high dimensional accuracy.

EXAMPLES

EXAMPLE 1

The metal powder used was a simplex iron powder composed of uniform spheres having a uniform particle distribution, a powder density of 7.604 g/cm$^3$ and a mean particle size of 1.34 μm of which the oxygen content was controlled to 0.7 wt. % and the hydrogen reduction loss was controlled to 2.62 wt. % (at 1000° C. for 30 min.). The organic binder used was a mixture of ethylene-vinyl acetate copolymer, polybutyl methacrylate, polystyrene, wax and dibutyl phthalate. 100 parts by weight of the iron powder was blended with 9 parts by weight of the organic binder mixture using a pressure type kneader at 130° C. at 4 kgf/cm$^2$ and the melt-mixture was pelletized. The pellets were molded into a cylindrical body having a size of 10 mm in diameter and 2 mm in thickness by an injection molding machine at a nozzle temperature of 150° C., an injection pressure of 1 t/cm$^2$ and a mold temperature of 30° C. The molded body was heated from room temperature to 450° C. in 8 hours according to a prescribed temperature rise program to remove the organic binder. The removal of the organic binder was 95%. The surface of the molded body was observed after the removal of the organic binder and no cracks, blisters or deformations were found.

Subsequently, the molded body was sintered. First, the molded body was heated from room temperature to 600° C. in 1 hour in a hydrogen-reducing atmosphere to remove the residual organic binder completely as well as to reduce the iron powder. The temperature was elevated from 600° C. to 1300° C. in one hour and the iron powder was reduced to substantially pure iron at a temperature lower than the sintering temperature during the temperature rise. Then, the molded body was sintered at 1400° C. for 3 hours. The relative density, i.e. the ratio to the theoretical density, of the sintered body was 99.5%, which was much higher than those of conventional products. As to the flow characteristics of the mixture of the metal powder with the organic binder, the reproducibility was investigated using a flow tester and the flow value was stable without a great deflection.

COMPARATIVE EXAMPLE 1

The metal powder used was conventional iron powder composed of irregular particles containing sintered powder and agglomerates having a powder density of 7.824 g/cm$^3$ and a mean particle size of 4.40 μm, of which the oxygen content was controlled to 0.04 wt. % and the hydrogen reduction loss was controlled to 0.17 wt. % (at 1000° C. for 30 min.). The organic binder was the same as Example 1 and all processes from blending to sintering were also the same as Example 1. The relative density of the sintered body was 90.3% and a great deflection occurred in the investigation of the reproducibility of the flow characteristics.

EXAMPLE 2

The correlation of the relative density of the sintered body with the sintering temperature was investigated using two kinds of iron powder having a different oxygen content and hydrogen reduction loss. One type of iron powder was the same as employed in Example 1, being a simplex composed of uniform spheres having a uniform particle distribution, a powder density of 7.604 g/cm$^3$ and a mean particle size of 1.34 μm, of which the oxygen content was controlled to 0.7 wt. % and the hydrogen reduction loss was controlled to 2.62 wt. % (at 1000° C. for 30 min.). The other type of iron powder was the same as employed in Comparative Example 1, being a conventional one composed of irregular particles containing sintered powder and agglomerates having a powder density of 7.824 g/cm$^3$ and a mean particle size of 4.40 μm of which the oxygen content was controlled to 0.04 wt. % (at 1000° C. for 30 min.). Using the above two kinds of iron powders, sintered bodies were prepared in the same process as Example 1, except for varying the sintering temperature.

As a result, the correlation between the relative density of the sintered body and the sintering temperature shown in FIG. 1 was obtained. In the figure, closed circles indicate the case of the simplex iron powder having an oxygen content of 0.70 wt. % and open circles indicate the case of the conventional iron powder having an oxygen content of 0.04 wt. %. As shown in the figure, in the case of using the conventional iron powder, since the melting point of pure iron is 1535° C., the sintering temperature must be rendered higher than 1450° C. in order to obtain a sintered body in a stable state having a relative density of more than 99%. Thus, the substantial range of the sintering temperature is only about 70° C. Besides, when a sintered body in a stable state having a relative density of more than 99% was obtained by sintering at a sintering temperature higher than 1450° C., the sintered body could not be used as a metal part of a precision instrument due to the surface roughness caused by the coarse grain boundaries. Whereas, in the case of using the iron powder shown in Example 1, sintered bodies in a stable state and having a relative density of more than 99% were obtained at a sintering temperature of 1100° C., which was much lower than the conventional sintering temperature of 1300° C. Therefore, in the case of using the iron powder shown in Example 1, sintered bodies in a stable state having a relative density of more than 99% can be produced at a sintering temperature lower than the conventional temperature and, moreover, in a wide sintering temperature range. That is, the process of the invention is very effective for producing a metal part of a precision instrument having a high density, in a good reproducibility and a good dimensional accuracy. In an industrial viewpoint, sintering at a low temperature reduces the manufacuturing cost of parts.

EXAMPLE 3

Figure 2:
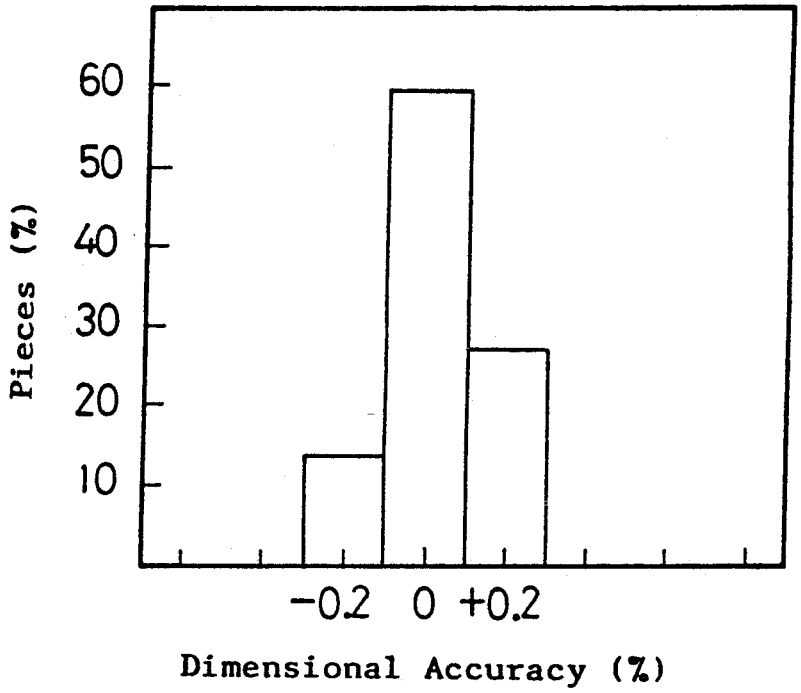
FIG. 2 is a bar graph indicating the dispersion in the outside diameter of 1000 sintered bodies produced in a repeated production test in an example of the invention.

The metal powder used was shown in Example 1 was simplex iron powder composed of uniform spheres having a uniform particle distribution, a powder density of 7.604 g/cm$^3$ and a mean particle size of 1.34 μm of which the oxygen content was controlled to 0.7 wt. % and the hydrogen reduction loss was controlled to 2.62 wt. % (at 1000° C. for 30 min.). 1000 pieces of the sintered body were produced using the above iron powder similar to Example 1. Each outside diameter of 1000 sintered bodies was measured, and the dispersion around the set value is shown in FIG. 2. As shown in the figure, the dispersion of the outside diameters was small and the sintered bodies were excellent in reproducibility and dimensional accuracy.

COMPARATIVE EXAMPLE 2

Figure 3:
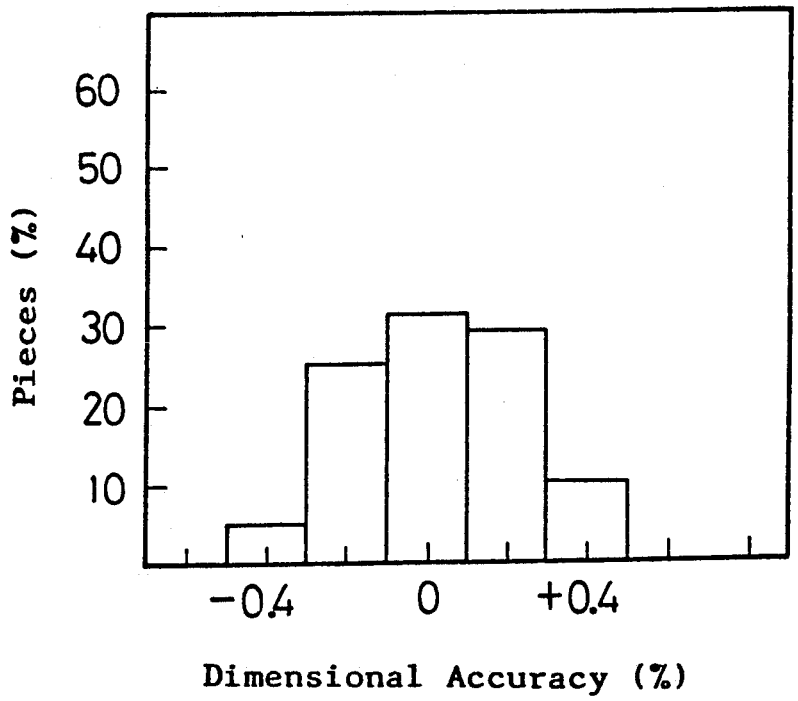
FIG. 3 is a bar graph of a comparative example.

The metal powder used was shown in Comparative Example 1 and was a conventional iron powder composed of irregular particles containing sintered powder and agglomerates having a powder density of 7.824 g/cm$^3$ and a mean particle size of 4.40 μm of which the oxygen content was controlled to 0.04 wt. % and the hydrogen reduction loss was controlled to 0.17 wt. % (at 1000° C. for 30 min.). 1000 pieces of the sintered body were produced using the above iron powder similar to Example 1. Each outside diameter of 1000 sintered bodies was measured and the dispersion around the set value is shown in FIG. 3. Compared with FIG. 2, the dispersion of the outside diameters was great and the sintered bodies were inferior in reproducibility and dimensional accuracy.

EXAMPLE 4

The metal powder used was a simplex Fe-50 wt. % Co alloy powder composed of uniform spheres having a uniform particle distribution, a powder density of 7.603 g/cm$^3$, a mean particle size of 12.4 μm , of which the oxygen content was controlled to 1.96 wt. % and the hydrogen reduction loss was controlled to 3.90 wt. % (at 500° C. for 3 hours.). The organic binder was the same as Example 1 and all steps from blending to reducing were also the same as Example 1. The sintering was conducted in a hydrogen-reducing atmosphere and the temperature was elevated from room temperature to 600° C. in 1 hour, from 600° C. to 700° C. in 1 hour and from 700° C. to 1400° C. for 3 hours, kept at 1400° C. in 3 hours and then cooled to room temperature for 2 hours. The relative density of the sintered body thus obtained was 95.5%.

COMPARATIVE EXAMPLE 3

The metal powder used was a simplex Fe-50 wt. % Co alloy powder composed of uniform spheres having a uniform particle distribution, a powder density of 8.15 g/cm$^3$ and a mean particle size of 11.37 μm , of which the oxygen content was controlled to 0.26 wt. % and the hydrogen reduction loss was controlled to 0.16 wt. % (at 500° C. for 3 hrs.). The organic binder was the same as Example 4 and all steps from blending to sintering were also the same as Example 4. The relative density of the sintered body thus obtained was 87.5 %, which was lower than Example 4.

EXAMPLE 5

Figure 5:
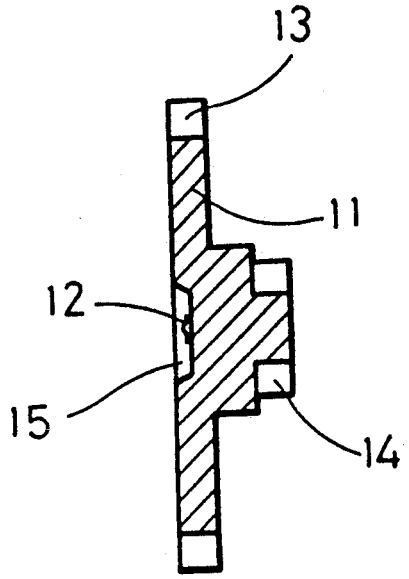
FIG. 5 is a sectional view of a minute wheel produced in an example of the invention.
Figure 6:
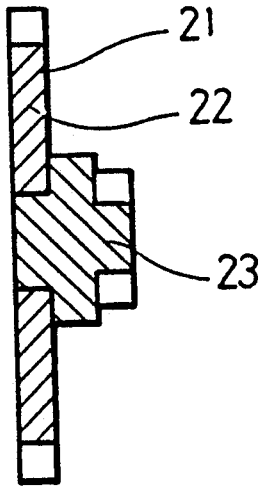
FIG.6 PRIOR ART
FIG. 6 a sectional view of a conventional minute wheel.
Figure 7:
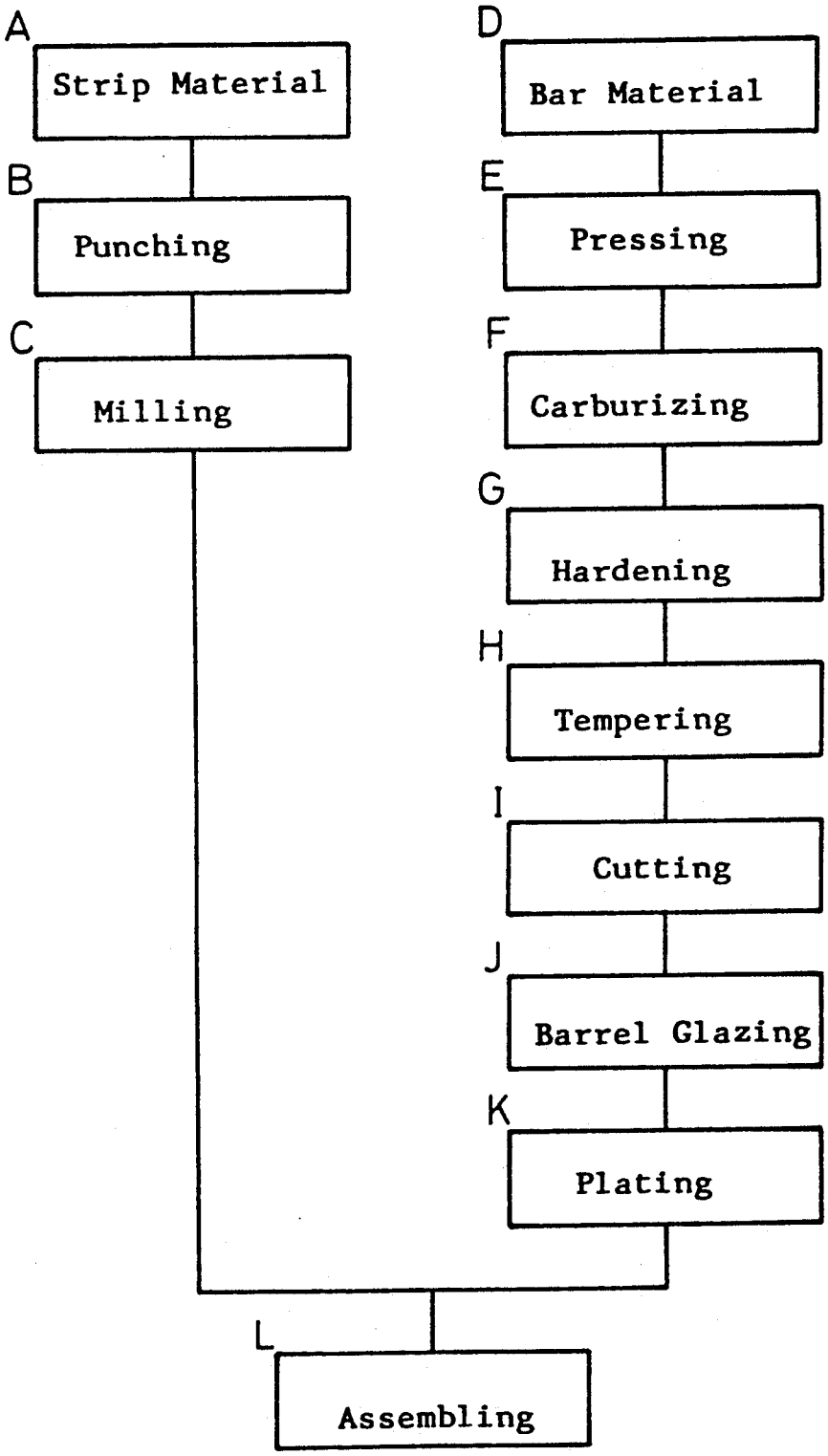
FIG. 7 PRIOR ART
FIG. 7 is a flow diagram of a conventional process for producing a minute wheel.

A minute wheel produced was a part of a watch and had a form shown in FIG. 5. The minute wheel 11 was produced according to the process of the invention and provided with a gear 13 engaged with a pinion (not illustrated) of the central wheel and pinion 14, located at the edge portion on the reverse side of the gear 13, engaged with a hour wheel (not illustrated). A gate portion 12, which corresponded to the gate for injection molding, was provided in the recess 15 at the center of the formed gear so as not to project the gate portion 12 to the outside. The outside diameter of the gate portion 12 was ϕ0.5 mm.

Figure 4:
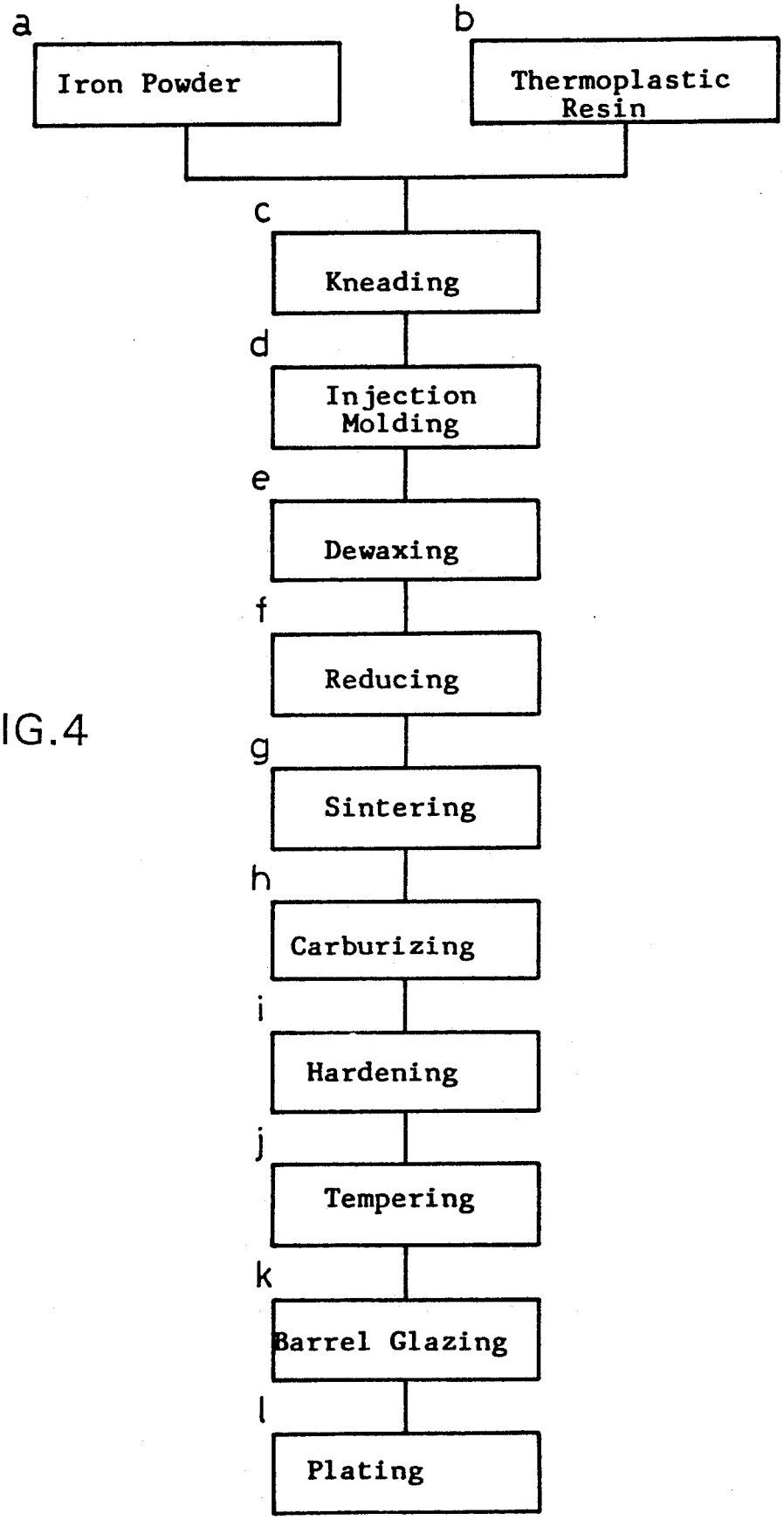
FIG. 4 is a flow diagram for producing a minute wheel employed in an example of the invention.

A flow diagram of the production of the above minute wheel is shown in FIG. 4. Unreduced fine iron powder being almost spherical and having a mean particle size of about 1.5 μm was prepared by the carbonyl method (step a). 100 parts by weight of the iron powder was mixed and kneaded homogeneously with 9 parts by weight of a mixture of ethylene-vinyl acetate copolymer, polybutyl methacrylate, polystyrene, wax and dibutyl phthalate as the binder (step b) by a mixer (step c) to produce the raw material for injection molding.

The raw material was injection-molded in a mold which was precisely prepared by using an injection molding machine (step d) to produce a pattern of the minute wheel (hereinafter referred to as semi-fabricated product) in a prescribed form. Injection molding was conducted at an injection molding pressure of 720 kgf/cm$^2$–1260 kgf/cm$^2$, an injection speed of 30 mm/sec-85 mm/sec, a heating cylinder temperature of 140° C.–170° C. and a mold temperature of 20° C.–50° C. The contraction rate of the molded body was about 0.5%.

After the injection molding, the semi-fabricated product was dewaxed by heating from ordinary temperature to 450° C. at a temperature elevation rate of 50° C./hr in a nitrogen gas atmosphere in order to remove the resin used as the binder (step e), followed by conducting the reduction at 450° C.–600° C. in a hydrogen gas atmosphere (step f). Then, the semi-fabricated product was sintered at 1370° C. for 3 hours in a hydrogen gas atmosphere or in vacuo to form a semifinished product which was finished in the form (step g). The semifinished product thus formed had no cracks, deformations or the like, and was excellent in appearance. The contraction rate of the semifinished product was about 18% to the semi-fabricated product.

As aftertreatments, the semifinished product was carburized at 840° C.–860° C. (step h), hardened at 800° C.–900° C. (step i) and then tempered at 200° C.–300° C. (step j). The surface hardness was controlled to Hv 650 by the above treatments.

Subsequently, barrel glazing was conducted in order to form a glazed face (step k) and electroless Ni plating was conducted in order to impart corrosion resistance (step l) to obtain the minute wheel 11 shown in FIG. 5.

The minute wheel thus produced was constructed by one part. The surface roughness was less than 1 μm, and the precision was sufficient as a part for watches. Moreover, since a desired hardness was obtained, it can be used as a part for wristwatches.

We claim:

1. A process for producing a precision iron or iron alloy part of a sintered body formed by powder molding, said process comprising the steps of forming a homogeneous mixture consisting essentially of an iron or iron alloy powder having an oxygen content of 0.5 to 6 wt. % and a hydrogen reduction loss of 1 to 7 wt. % by controlling the reduction of the iron or iron alloy powder, and an organic binder, forming the mixture into a molded body having a prescribed form, removing the organic binder from the molded body in an inert atmosphere, reducing said iron or iron alloy powder contained in the molded body to remove oxygen therefrom and form a reduced molded body and sintering the reduced molded body.

2. The process of claim 1, wherein the iron or iron alloy powder is composed of spherical particles.

3. The process of claim 1, wherein the iron or iron alloy powder is a simplex composed of uniform spheres having a uniform particle distribution.

4. The process of claim 1, wherein the mean particle size of the iron or iron alloy powder is from 0.1 to 10 μm.

5. The process of claim 1 wherein more than 90 wt. % of the organic binder is removed from the molded body before the process of reducing.

6. A process for producing a precision metal part of a sintered body formed by powder molding, said process comprising the steps of forming a homogeneous mixture consisting essentially of one or more kinds of metal powders having an oxygen content of between 0.5 to 6 wt. % and an organic binder, forming the mixture into a molded body having a prescribed form, removing the organic binder from the molded body in an inert atmosphere, reducing the one or more kinds of metal powders contained in the molded body and sintering the reduced molded body.

7. The process of claim 6, wherein the metal powders have a hydrogen reduction loss of from 1 to 7 wt. % before the reduction step.

8. A process for producing a part of a watch which comprises the steps of producing a homogeneous mixture of a fine uniform iron powder having an oxygen content of 0.5 to 6 wt. % and a plastic binder, forming the mixture into a molded body by injection molding, removing the plastic binder and sintering to produce a semi-fabricated product having a complete form, hardening at least the surface of the semi-fabricated product and plating the surface of the semi-fabricated product.

* * * * *

UNITED STATES PATENT AND TRADEMARK OFFICE

CERTIFICATE OF CORRECTION

PATENT NO. : 5,283,031

DATED : February 1, 1994

INVENTOR(S) : Naoto Ogasawara et al

It is certified that error appears in the above-identified patent and that said Letters Patent is hereby corrected as shown below:

On title page, item [54] and col. 1, line 1, "PORDUCING" should read --PRODUCING--

Column 9, line 7; after "claim 1" insert a comma ---,---.

Signed and Sealed this

Fourteenth Day of June, 1994

*Attest:*

Bruce Lehman

BRUCE LEHMAN

*Attesting Officer*

*Commissioner of Patents and Trademarks*